US006121725A

United States Patent [19]

Grand-Clement et al.

[11] Patent Number: 6,121,725

[45] Date of Patent: Sep. 19, 2000

[54] FLAT DISPLAY SCREEN WITH FOCUSING GRIDS

[75] Inventors: Jean-Luc Grand-Clement, Rousset; Axel Jager, Sussargues, both of France

[73] Assignee: Pixtech S.A., Rousset, France

[21] Appl. No.: 08/969,899

[22] Filed: Nov. 13, 1997

[30] Foreign Application Priority Data

Nov. 22, 1996 [FR] France ..... 9614615

[51] Int. Cl.[7] ..... H01J 1/30; H01J 19/24

[52] U.S. Cl. ..... 313/497; 313/422

[58] Field of Search ..... 313/306, 307, 313/308, 309, 336, 351, 495, 496, 497, 422

[56] References Cited

U.S. PATENT DOCUMENTS 5,541,473 7/1996 Duboc, Jr. et al. ..... 313/422

5,565,742 10/1996 Shichao et al. ..... 313/422

5,850,120 12/1998 Okamoto ..... 313/336

OTHER PUBLICATIONS

Patent Abstracts of Japan, vol. 018, No. 073 (E–1503), Feb. 7, 1994 & JP 05 290767 A (Nippon Steel Corp.), Nov. 5, 1993.

*Primary Examiner*—Michael Day

*Attorney, Agent, or Firm*—Arthur L. Plevy

[57] ABSTRACT

The present invention relates to a flat color display screen including a cathode associated with an electron extraction grid, an anode provided with at least two types of phosphor elements, all polarized to a same potential, and at least two additional superposed grids, positioned on the extraction grid, and each provided with holes defining sub-pixels associated with each of the colors. Each additional grid is associated with a color and some of the holes thereof are of smaller diameter than the coaxially corresponding holes of the other additional grids, for activating the sub-pixels of the corresponding color.

10 Claims, 4 Drawing Sheets

FLAT DISPLAY SCREEN WITH FOCUSING GRIDS

BACKGROUND OF THE INVENTION

1. Field of the Invention

The present invention relates to a flat color display screen, and more specifically to so-called "cathodoluminescence" screens, the anode of which carries phosphor elements likely to be energized by electron bombarding. This electron bombarding can come from microtips, from layers of low extraction potential or from a thermo-ionic source.

2. Discussion of the Related Art

To simplify the present description, only color microtip screens will be considered hereafter, but it should be noted that the present invention relates, generally, to the various types of above-mentioned screens and the like.

FIG. 1 very schematically shows the conventional structure of a flat color microtip display screen of the so-called "switched-anode" type.

Such a microtip screen is essentially formed of a cathode 1 with microtips 2 and of a grid 3 provided with holes 4 corresponding to the locations of microtips 2. The cathode/grid is placed opposite to a cathodoluminescent anode 5, from which it is separated by a vacuum space 12, and a glass substrate 6 of which forms the screen surface.

Cathode 1 is organized in columns and is formed, on a glass substrate 10, of cathode conductors organized in meshes from a conductive layer. Microtips 2 are implemented on a resistive layer 11 deposited on the cathode conductors and are disposed inside the meshes defined by the cathode conductors. FIG. 1 partially shows the inside of a mesh and the cathode conductors do not appear on the drawing. Cathode 1 is associated with grid 3 organized in lines. The intersection of a line of grid 3 and of a column of cathode 1 defines a pixel.

Anode 5 is generally provided with alternate bands of phosphor elements 7*r*, 7*g*, 7*b*, each corresponding to a color (Red, Green, Blue). The bands are parallel to the cathode columns and are separated from one another by an insulator 8. Phosphor elements 7 are deposited on electrodes 9 formed of corresponding bands of a transparent conductive layer such as indium and tin oxide (ITO). The sets of red, green, blue, bands are alternatively polarized with respect to cathode 1, so that the electrons extracted from the microtips 2 of a pixel by the electric field created between cathode 1 and grid 3 are alternatively attracted by the phosphor elements 7 of each of the colors.

To increase the brightness of the screen, it is desirable to increase the anode-cathode voltage and thus the anode-cathode distance defined by space 12. This raises two particular problems. The first one is that it is difficult, with existing components, to rapidly switch high voltages, and that this results in high power consumption. The second one is that the larger the inter-electrode space, the more the electrons emitted by the microtips scatter and tend to cause a parasitic illumination of the pixels neighboring that which is desired to be illuminated.

To solve the first problem, so-called "unswitched-anode" screens, the anode of which is formed of phosphor elements of different colors, all simultaneously polarized to a same potential, can be used. In this type of screen, the selection of the color of the phosphor element to be energized is obtained, on the cathode side, by dividing each column of the cathode into three sub-columns respectively associated with each of the colors.

However, the second problem of parasitic illumination remains. This phenomenon is even more critical in this case since the electrons also bombard phosphor elements of another color.

SUMMARY OF THE INVENTION

The present invention aims at overcoming the disadvantages of conventional screens by providing a flat color unswitched-anode display screen which can withstand a high inter-electrode voltage (of around 2 to 10 kV) without prejudice to the screen definition.

The present invention also aims at providing such a flat display screen of high inter-electrode voltage which does not require to switch the cathode conductors according to the color to be displayed.

To achieve this object, the present invention provides a flat color display screen including a cathode associated with an electron extraction grid; an anode provided with at least two types of phosphor elements, all polarized to a same potential; and at least two additional superposed grids, positioned on the extraction grid, isolated from each other and from the extraction grid, each of the additional grids provided with holes, each hole of each additional grid being coaxial with one of the holes of each other additional grid, the holes of each additional grid defining sub-pixels, each sub-pixel associated with one of a plurality of colors, each additional grid being associated with one of the plurality of colors, wherein some of the holes of each additional grid 0 are of smaller diameter than coaxially corresponding holes of the other additional grids, for activating the sub-pixels of the corresponding colors.

According to an embodiment of the present invention, each additional grid includes two series of holes of different diameters, the diameter of the holes with the smaller diameter of each additional grid being smaller than the diameter of the holes of greater diameter of the other additional grids.

According to an embodiment of the present invention, each additional grid is formed of a perforated metal sheet.

According to an embodiment of the present invention, the screen includes means for individually polarizing the additional grids.

The present invention also provides a method of control of a flat color display screen consisting of sequentially polarizing each additional grid to a respective potential of activation of the sub-pixels of the corresponding color, the other additional grids being brought to respective potentials of inhibition of the sub-pixels of the corresponding colors.

According to an embodiment of the present invention, the respective activation potentials of the additional grids are positive or equal to zero, their respective inhibition potentials being lower than a minimum potential of polarization of the cathode.

According to an embodiment of the present invention, the activation potential of each additional grid is chosen according to the diameter of its holes of smaller diameter.

According to an embodiment of the present invention, the activation potential of each additional grid is chosen according to the distance which separates this additional grid from the extraction grid.

According to an embodiment of the present invention, the respective potentials of inhibition of the additional grids are identical.

According to an embodiment of the present invention, the polarization potential of the phosphor elements of the anode is included between 2 and 10 kV.

The foregoing objects, features and advantages of the present invention will be discussed in detail in the following non-limiting description of specific embodiments, in conjunction with the accompanying drawings.

BRIEF DESCRIPTION OF THE DRAWINGS

FIGS. 3A to 3C illustrate the operation of a screen according to the present invention.

DETAILED DESCRIPTION

The same elements have been referred to by the same references in the different drawings. For clarity, the representations of the drawings are not to scale.

Figure 1:
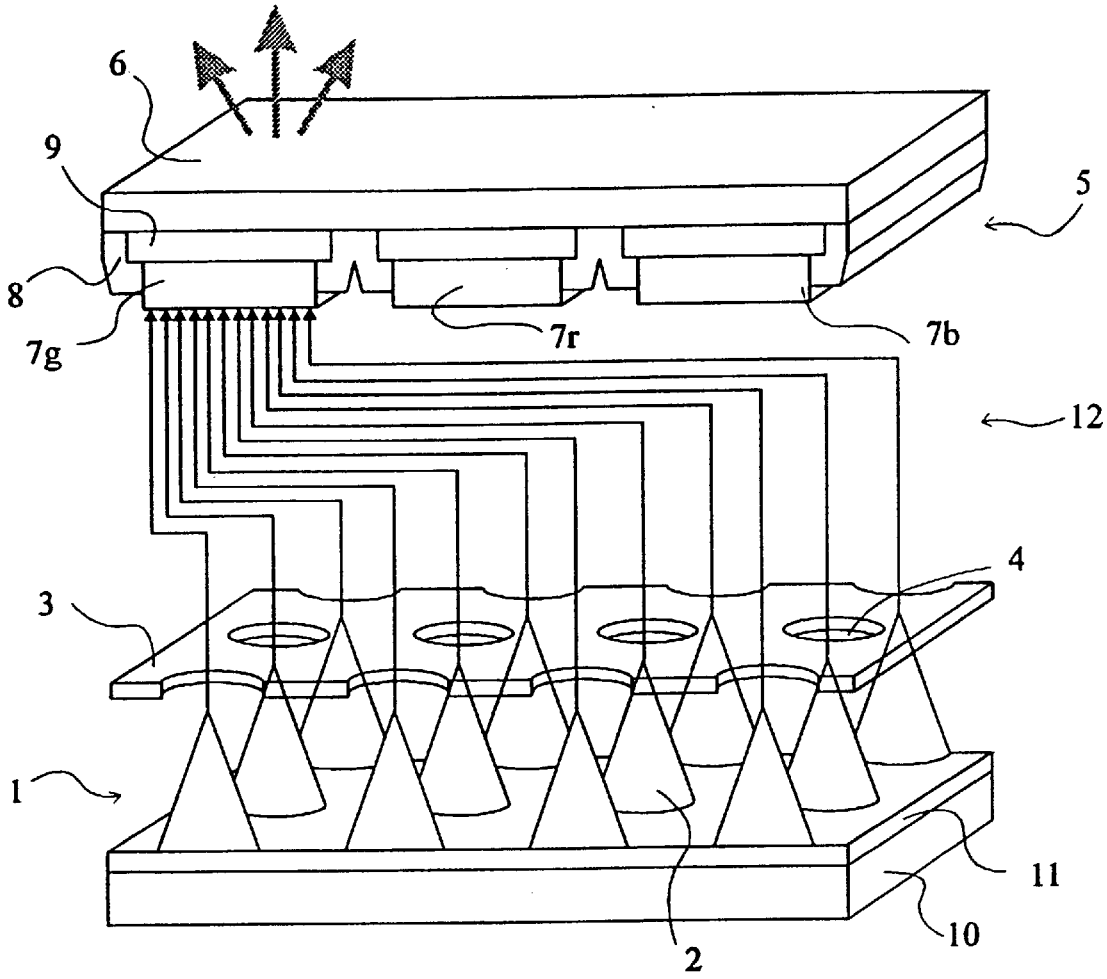
Fig 1 (PRIOR ART)
FIG. 1, previously described, is meant to show the state of the art and the problem to solve.
Figure 2:
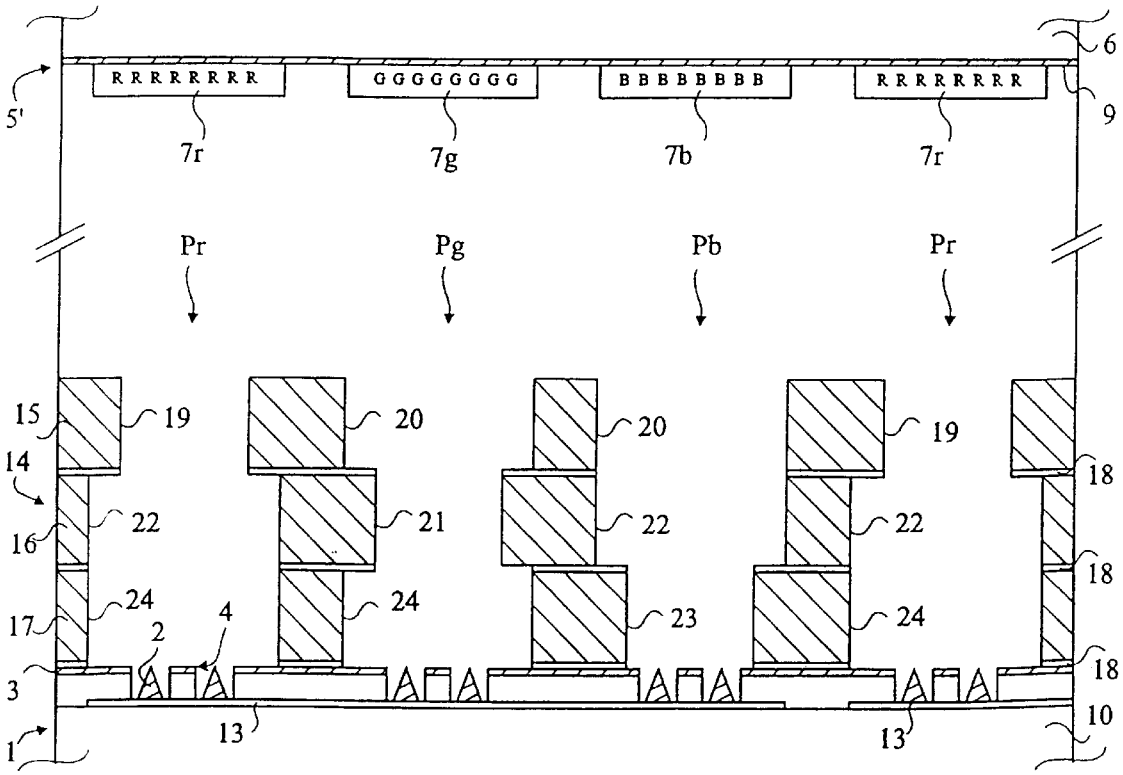
FIG. 2 shows, partially and in cross-sectional view, an embodiment of a flat screen according to the present invention.
Figure 1:
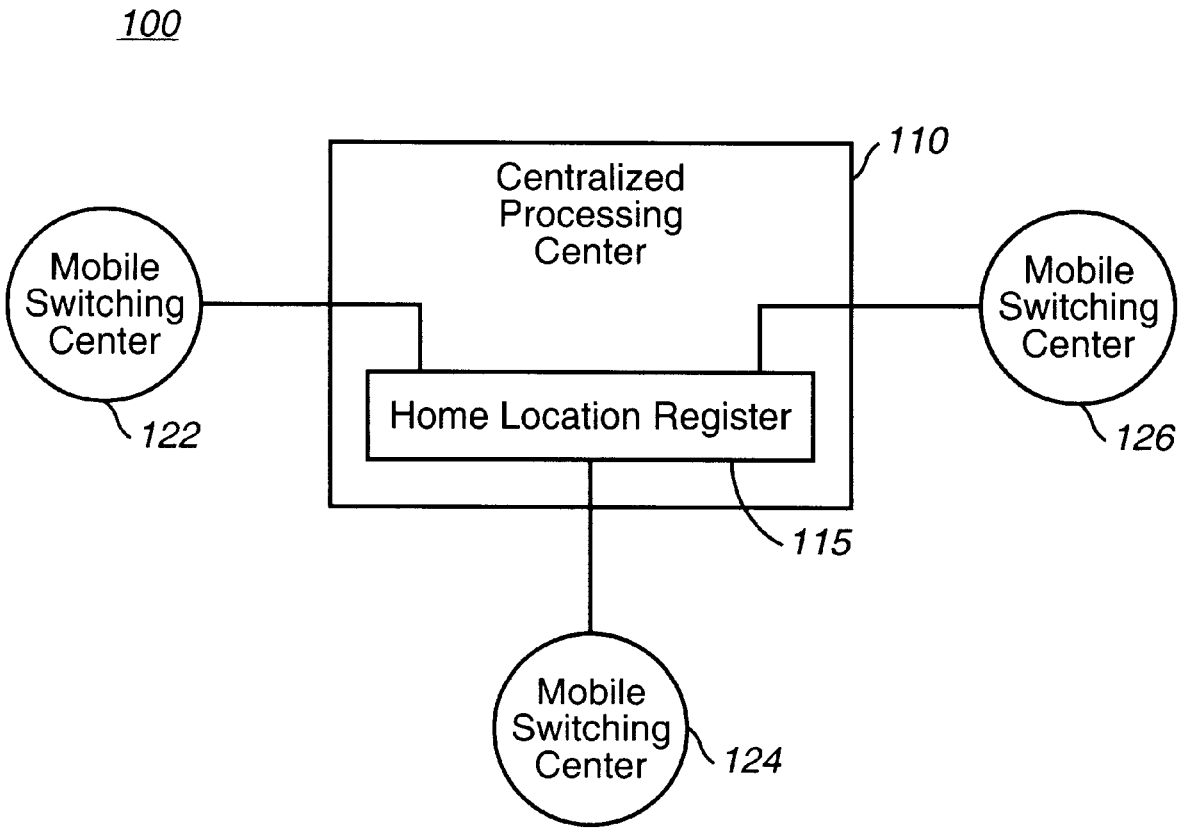

FIG. 2 is a cross-sectional view of an embodiment of a microtip screen according to the present invention. As previously (FIG. 1), this screen includes a cathode 1 with microtips 2 and an extraction grid 3 provided with holes 4 corresponding to the locations of microtips 2. A meshing of cathode conductors organized in columns is performed on a glass substrate 10. Microtips 2 rest on a resistive layer formed on and between the cathode conductors and are disposed inside the meshes defined by the cathode conductors. In FIG. 2, the resistive layer and the cathode conductors of a column have been generally referred to by reference 13. Grid 3 is, as previously, organized in lines. The intersection of a line of grid 3 and of a column 13 of cathode 1 defines a pixel.

According to the present invention, the cathode/grid is associated with an anode 5' formed of regions (for example, alternate parallel bands like in FIG. 1) of phosphor elements 7*r*, 7*g*, and 7*b* deposited on a common electrode 9 formed of a plane of a transparent conductive layer such as indium and tin oxide (ITO). Layer 9 is deposited on a glass substrate 6 forming the screen surface. Thus, all phosphor elements 7 are simultaneously polarized with respect to cathode 1.

A characteristic of a screen according to the present invention is that it includes, on the cathode side, a structure of additional grids 14 for focusing the electrons emitted by the microtips towards the regions of phosphor elements 7 of same color. Structure 14 is, in this embodiment, formed of three focusing grids 15, 16, and 17, respectively associated with each of the colors. Hereafter, it will be spoken of "red", "green", and "blue" grids. Grids 15, 16, and 17 are positioned on extraction grid 3 and are separated from one another and from grid 3 by an insulator 18.

Each pixel of the screen (defined by the intersection of a line of grid 3 with a column 13 of cathode 1) is divided into three sub-pixels, respectively Pr, Pg, and Pb, defined by three coaxial holes provided in grids 15, 16, and 17. Each sub-pixel of the cathode/grid Pr, Pg, Pb faces a region of phosphor elements, respectively 7*r*, 7*g*, or 7*b* corresponding to the sub-pixel of the considered color, on the side of anode 5'. For clarity, only two microtips 2 per sub-pixel have been shown. It should however be noted that the microtips are, in practice, as many as several thousands per screen pixel.

According to the present invention, each "red", "green", or "blue" grid 15, 16, or 17, includes holes, respectively 19, 21, or 23, of activation or inhibition of the sub-pixels of the corresponding color. Holes 19, 21, or 23 of each grid 15, 16, or 17 are of a reduced diameter with respect to the coaxial holes, respectively 22 and 24, 20 and 24, or 20 and 22, of the two other grids. The function of holes 19, 21, and 23 of reduced diameter is to enable, according to the polarization of grids 15, 16, and 17, either to block or to focus the electrons emitted by the microtips 2 facing holes 19, 21, and 23, according to the color to be displayed. Preferably and as shown in FIG. 2, grids 15, 16, and 17 include, each, two series of holes, respectively 19 and 20, 21 and 22, or 23 and 24, of different diameters.

FIGS. 3A to 3C illustrate the operation of a screen according to the present invention. FIGS. 3A, 3B, and 3C schematically show an example of polarization of additional grids 15, 16, and 17 of a screen according to the present invention, respectively, for each of the three colors. For clarity, the details constitutive of cathode 1 and of extraction grid 3 have not been reproduced in FIGS. 3A to 3C.

The display is performed by sub-frames associated with each color. For example, the rows of grid 3 are sequentially polarized to a potential of around 80 volts, while columns 13 of cathode 1 are brought to respective potentials included between a maximum emission potential and a no-emission potential (for example, respectively 0 and 30 volts). Preferably, anode 5' is polarized to a high potential (for example, on the order of 2 to 10 kV).

During a second sub-frame (FIG. 3A), for example red, "red" grid 15 is polarized to a positive activation potential (for example, +30 volts), while the "green" and "blue" grids 16 and 17 are polarized to a more negative inhibition potential than the minimum polarization potential of columns 13 of cathode 1 (for example, −30 volts). Thus, the electrons emitted facing holes 19, along the polarized line of grid 3, are focused by "red" grid 15 for bombarding phosphor elements 7*r* of the corresponding pixels. Conversely, the electrons emitted facing holes 21 and 23 are blocked by the negative polarization potential of the "green" and "blue" grids 16 and 17 and are then collected by extraction grid 3 at the potential of 80 volts.

During the following sub-frames (FIGS. 3B and 3C), the above-described operation is repeated for "green" grid 16, then for "blue" grid 17.

The value of the activation potential of grid 15, 16, and 17 meant to focus the electrons depends, in particular, on the distance from this grid to extraction grid 3, as well as on the diameter of its holes of reduced diameter, respectively 19, 21, or 23. For example, the activation potential of the most distant grid from grid 3 (here, "red" grid 15) is the most positive and the activation potential of the closest grid to cathode 1 (here, "blue" grid 17) is the least positive, or even equal to zero.

It should also be noted that the negative inhibition potentials of the two additional grids, used to block the electrons of the sub-pixels which do not correspond to the color to be displayed, can be different from each other. However, since it is enough for the hole of reduced diameter of a given sub-pixel to be at a negative potential to block the electrons, the choice of a single negative inhibition potential enables to simplify the control of structure 14 by means of an electronic screen control circuit.

The reduced diameter of holes 19, 21, or 23 of each grid, respectively 15, 16, or 17, is chosen according to the inter-electrode distance (and thus, according to the inter-electrode voltage) to perform a focusing of the electrons on the regions of phosphor elements associated with the corresponding holes. Further, holes 19, 21, and 23 have a shape chosen to optimize the focusing and the blocking of the electrons according to their polarization. For example, the edges can be straight, round, tapered, or chamfered in the direction of the anode or of the cathode.

The diameters of holes 19, 21, and 23 can be different from one another, provided that these diameters are, respectively, lower than the diameters of the holes (22 and 24, 20 and 24, 20 and 22) of the other grids (16 and 17, 15 and 17, 15 and 16) to which they are coaxial.

The thickness of additional grids 15, 16, and 17 is much greater than the thickness of the layers constitutive of cathode 1 associated with extraction grid 3. As a specific example, the general thickness of cathode 1 associated with grid 3 is on the order of 1 to 5 $\mu$m, for example 3.5 $\mu$m, and the thickness of each additional grid 15, 16, or 17 is on the order of 50 $\mu$m.

An advantage of the present invention is that it enables to implement a fast display screen of high inter-electrode voltage without requiring the use of high voltage switching components, the selection of the color to be displayed being performed by structure 14 of low voltage additional grids.

Another advantage of the present invention is that it ensures an optimal focusing of the electrons towards the sub-pixels of the corresponding color.

As an alternative embodiment, columns 13 of cathode 1 can be divided into sub-columns addressed independently from one another. In this case, the color selection is performed by means of the cathode sub-columns. Structure 14 of additional grids then has the function of ensuring an optimal focusing of the electrons and of enabling a high inter-electrode voltage.

Another advantage of the present invention is that by enabling the polarization of the anode under a high voltage, phosphor elements of the type of those used in color television cathode-ray tubes, the techniques of manufacturing of which are perfectly mastered, can now be used.

Another advantage of the present invention is that by enabling the implementation of an anode, the phosphor elements of which are all simultaneously polarized, the alternate bands of phosphor elements conventionally used in microtip screens can be replaced with pellets of phosphor elements of each color corresponding to each sub-pixel.

Figure 4:
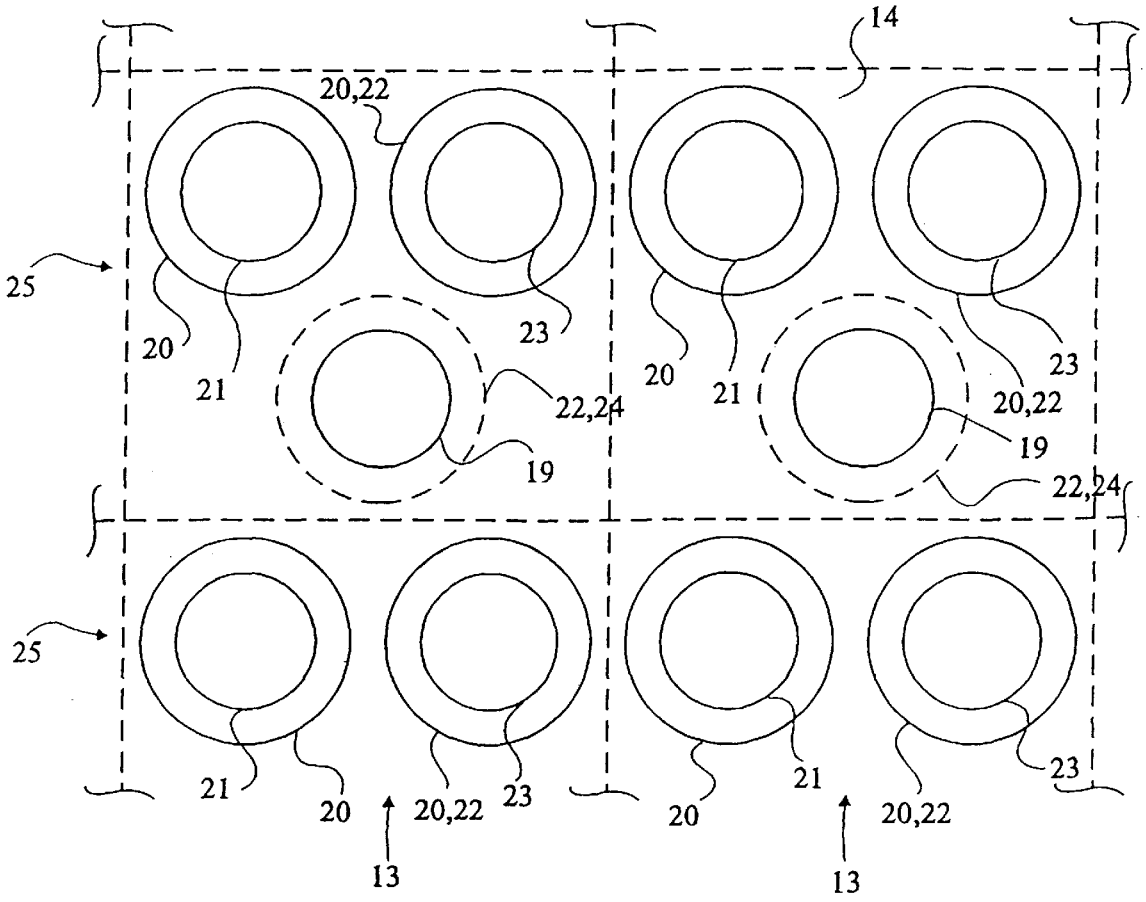
FIG. 4 is a partial top view of a cathode/grid according to an embodiment of the present invention.

FIG. 4 is a top view of a structure of additional grids according to the present invention meant to be associated with an anode supporting three pellets of phosphor elements of different colors for each pixel.

Holes 19 to 23 of structure 14 are then disposed, for each pixel defined by the intersection of a line 25 of grid 3 and of a column 13 of cathode 1, according to the disposition, on the anode side, of pellets of phosphor elements (not shown).

In the embodiment shown in FIG. 4, the sub-pixels of a given pixel are disposed in a substantially triangular way, which enables to balance the bulk of each pixel in both directions. It should however be noted that the distribution of the sub-pixels must remain coherent with the organization in columns or in sub-columns of the cathode.

Although reference has been made in the foregoing description to a color screen, the anode of which includes three different types of phosphor elements, the present invention also applies to the case where the anode is provided with two different types of phosphor elements, for example, to a bichrome screen, the phosphor elements of which are distributed by pellets of the size of a sub-pixel or by bands of the width of a sub-pixel. In this case, only two additional grids according to the present invention are provided.

In an embodiment of the present invention, each additional grid 15, 16, 17 is formed of a perforated metal sheet isolated on at least one of its surfaces. These sheets are assembled so as to align their openings and are then disposed on the extraction grid of the cathode plate of the screen. Then, an anode plate is mounted on the upper grid with interposed spacers. However, many alternative embodiments will appear to those skilled in the art.

Of course, the present invention is likely to have various alterations, modifications, and improvements which will readily occur to those skilled in the art. In particular, the shape and diameter of the holes of the additional grids as well as the respective potentials of activation and inhibition of the additional grids will be chosen to optimize the focusing towards the corresponding sub-pixels.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A flat color display screen including:

a cathode (1) associated with an electron extraction grid (3);

an anode (5') provided with at least two types (7*r*, 7*g*, 7*b*) of phosphor elements, all polarized to a same potential; and at least two additional superposed grids (15, 16, 17), positioned on the extraction grid (3), isolated from each other and from the extraction grid, each of the additional grids provided with holes, each hole of each additional grid being coaxial with one of the holes of each other additional grid, the holes (19, 20; 21, 22; 23, 24) of each additional grid defining sub-pixels (Pr, Pg, Pb), each sub-pixel associated with one of a plurality of colors, each additional grid (15; 16; 17) being associated with one of the plurality of colors, wherein some of the holes (19; 21; 23), of each additional grid are of a smaller diameter than coaxially corresponding holes of the other additional grids, for activating the sub-pixels of the corresponding colors.

2. The screen of claim 1, wherein each additional grid (15; 16; 17) include two series of holes (19, 20; 21, 22; 23, 24) of different diameters, the diameter of the holes (19, 21, 23) with the smaller diameter of each additional grid being smaller than the diameter of the holes of greater diameter of the other additional grids.

3. The screen of claim 1, wherein each additional grid (15; 16; 17) is formed of a perforated metal sheet.

4. The screen of claim 1, including means for individually polarizing the additional grids (15; 16; 17).

5. A method of control of the flat color display screen of claim 1, consisting of sequentially polarizing each additional grid (15; 16; 17) to a respective potential of activation of the sub-pixels (Pr; Pg; Pb) of the corresponding color, the other additional grids being brought to respective potentials of inhibition of the sub-pixels of the corresponding colors.

6. The control method of claim 5, wherein the respective activation potentials of the additional grids (15; 16; 17) are positive or equal to zero, their respective inhibition potentials being lower than a minimum potential of polarization of the cathode (1).

7. The control method of claim 5, wherein the activation potential of each additional grid (15; 16; 17) is chosen according to the diameter of its holes (19, 21, 23) of smaller diameter.

8. The control method of claim 5, wherein the activation potential of each additional grid (15; 16; 17) is chosen according to the distance which separates this additional grid (15; 16; 17) from the extraction grid (3).

9. The control method of claim 5, wherein the respective potentials of inhibition of the additional grids (15; 16; 17) are identical.

10. The control method of claim 5, wherein the polarization potential of the phosphor elements (7*r*, 7*g*, 7*b*) of the anode (5') is included between 2 and 10 kV.

* * * * *